United States Patent [19]

Riese

[11] Patent Number: 4,637,061

[45] Date of Patent: Jan. 13, 1987

[54] SPECIMEN, SAMPLE COLLECTION AND TRANSPORT CONTAINER

[76] Inventor: J. Richard Riese, 1098 Queen Ann Dr., San Jose, Calif. 95129

[21] Appl. No.: 811,698

[22] Filed: Dec. 20, 1985

[51] Int. Cl.[4] ..... B65D 27/08; B65D 33/24

[52] U.S. Cl. ..... 383/38; 383/65; 383/35; 206/219; 206/221; 206/569

[58] Field of Search ..... 206/219, 221, 569, 527; 383/65, 63, 38, 35

[56] References Cited

U.S. PATENT DOCUMENTS

| | | | |
|---|---|---|---|
| 2,780,261 | 2/1957 | Svec et al. | 383/65 |
| 2,916,197 | 12/1959 | Detrie et al. | 229/56 |
| 3,077,262 | 2/1963 | Gaste | 206/221 |
| 3,156,352 | 11/1964 | Hayhurst | 206/219 |
| 3,575,225 | 4/1971 | Muheim | 150/8 |
| 3,660,033 | 5/1972 | Schwartz | 23/230 R |
| 3,776,220 | 12/1973 | Monaghan | 206/569 |
| 3,988,184 | 10/1976 | Howard | 156/66 |
| 4,122,945 | 10/1978 | Falla | 206/569 |
| 4,294,582 | 10/1981 | Naslund | 23/230 B |
| 4,311,792 | 1/1982 | Avery | 435/30 |
| 4,458,811 | 7/1984 | Wilkinson | 383/38 |
| 4,465,488 | 8/1984 | Richmond | 604/414 |
| 4,467,588 | 8/1984 | Carveth | 53/425 |
| 4,484,920 | 11/1984 | Kaufman et al. | 604/416 |

*Primary Examiner*—William Price
*Assistant Examiner*—Brenda J. Ehrhardt
*Attorney, Agent, or Firm*—Thomas Schneck

[57] ABSTRACT

A specimen, sample collection and transport container comprising a flexible plastic bag which is separated into selectively sealed chambers by leak-proof interlocking, multiple track, reclosable fasteners. The bag comprises a sheet of coextruded polyethylene-Saran-polyethelene material which is folded in half and sealed at the side edges. An interior fastener substantially traverses the container parallel to the folded bottom, thereby defining a lower chamber. An entrance fastener is affixed to the upper edges to selectively seal the entrance. Gripper flaps are added to the exterior of the container to facilitate the opening of the interior fastener. The lower chamber is supplied with a fixative or transport solution which is introduced by clipping or puncturing the lower corner or edge of the bag. The corner or hole is then sealed.

13 Claims, 8 Drawing Figures

SPECIMEN, SAMPLE COLLECTION AND TRANSPORT CONTAINER

DESCRIPTION

TECHNICAL FIELD

The invention relates to a self-contained specimen, sample collection and transport bag.

BACKGROUND ART

During medical procedures, a physician, surgeon or technician may remove a specimen from a patient for analysis. In most cases, speciment analysis takes place at locations other than the one at which the operation is performed. To protect the specimen during storage or transportation to another site, the specimen must be preserved in some kind of solution.

The solution in which a specimen is stored depends on factors such as the distance a specimen must travel, storage time, and the particular specimen involved. But whether the solution is selected for its fixation values or is a transport medium, a specimen solution is frequently expensive, odorous, irritative, and sometimes even toxic. Therefore, the choice of the proper specimen collection and transport container is an important consideration. Glass and plastic bottles are currently filled with solution, usually just before use.

Most specimen collection containers are single chamber vessels. U.S. Pat. No. 3,575,225 Muheim teaches a single chamber container which is partially filled with solution prior to a medical operation so that the surgeon may place specimens into the solution.

Multiple chambered containers are known in the medical field. U.S. Pat. No. 4,311,972 to Avery discloses a microbial culture collection plastic tube having a frangible glass ampule which is broken after a culture-carrying swab is placed in the plastic tube. The ampule releases a liquid culture-sustaining medium into the remainder of the tube.

U.S. Pat. Nos. 3,660,033 to Schwartz and 4,294,582 to Nashlund disclose multi-chambered vessels that are designed for urinalysis. The liquid urine specimen is held in a storage chamber and a reacting agent is placed in an analysis chamber. The testing occurs when a portion of the specimen is allowed into the analysis chamber of the vessel.

U.S. Pat. Nos. 4,465,488 to Richmond et al., 4,467,588 to Carveth, and 4,484,920 to Kaufman et al. disclose containers having two or more chambers separated by frangible closures. Each chamber contains a sterilized component, usually a medical agent. When the closures are broken, the components mix together and can then be administered to a patient.

In industrial situations, multiple chambered containers are made to separate liquid epoxy resins from a suitable hardener until the epoxy is to be used. U.S. Pat. No. 2,916,197 to Detrie et al. teaches such a container. The four edges of a plastic bag are heat sealed shut and the epoxy chamber and the hardener chamber are separated by any one of a variety of internal dividing means. The dividing means may be a heat seal, a thin membrane, adhesive, or pair of opposed mating members. Once the dividing means is broken, the epoxy and the hardener mix. The ingredients may then be dispensed directly from the container after a corner of the bag has been cut away. In such a container, bag contents are not intended to be stored after dispensing. Also, components cannot be added to the bag through the heat-sealed edges.

An object of the present invention is to provide a specimen, sample collection and transport container which permits safe and convenient handling of specimens or samples. A further objective is to provide a container which is transparent, air-tight, leak and odor proof for mixing samples with fixatives or media followed by transport and storage. A third objective is to provide a container which minimizes the cost of handling, storing, and transporting specimens or samples.

DISCLOSURE OF THE INVENTION

The above objects have been met by discovery of a unitary specimen collection and transport container. the container is made of a flexible, heat sealable material and includes at least two reclosable fasteners.

In the preferred embodiment, the present invention is a multi-layered, coextruded plastic pag having a first interlocking, multiple track, reclosable fastener extending across the interior of the bag parallel to the bottom at or below the mid-section of the bag. this interior fastener divides the bag into two chambers. A second such fastener, parallel to the first and spaced therfrom, is affixed to the upper edges of the bag and is used to selectively seal the entrance of the container.

The reclosable fasteners have first and second press-fit mating positions which are attached to opposite sides of the bag. The mating portions are rectangular closure strips with longitudinally extending protrusions and grooves aligned to interlock with protrusions and grooves of the opposed mating portion. The fasteners may be opened and then resealed any number of times and are leak-proof.

The bag is constructed by folging a sheet of heat resealable material to form two generally parallel walls and then heat sealing the side edges. Gripper flaps are added to the exterior of the bag outside each wall's junction with the interior fastener. The gripper flaps facilitate the opening of the interior fastener.

The lower chamber is to be filled with a fixative or transport solution at the time of manufacture. This elminates handling or breathing of the solution at the point of use. The specimen is placed in the upper chamber. Air is expelled through the top fastener, then the bag is closed and sealed. The interior fastener is then opened and the solution is gently mixed with the specimen. If the container has not already been labeled for identification, medical or laboratory personnel do so directly on the exterior bag label and the specimen is then ready for transportation.

An advantage of the present invention is that it provides a more convenient approach to specimen handling. The specimens or samples are collected, identified and transported in one leak-proof unit. Another advantage is that the container diminishes the problems of specimen and fixative handling and exposure. The possibility of solution contamination is greatly reduced and so the chance of infection dissemination from contaminated material or diseased specimens.

A third important advantage of the present invention is that the container reduces medical or laboratory costs. Fewer materials are needed since the system of collection and transportation is entirely selfcontained. The time of the personnel is saved and the loss of contents is reduced. Additionally, the specimen container may be retained for long term storage.

BEST MODE FOR CARRYING OUT THE INVENTION

Figure 1:
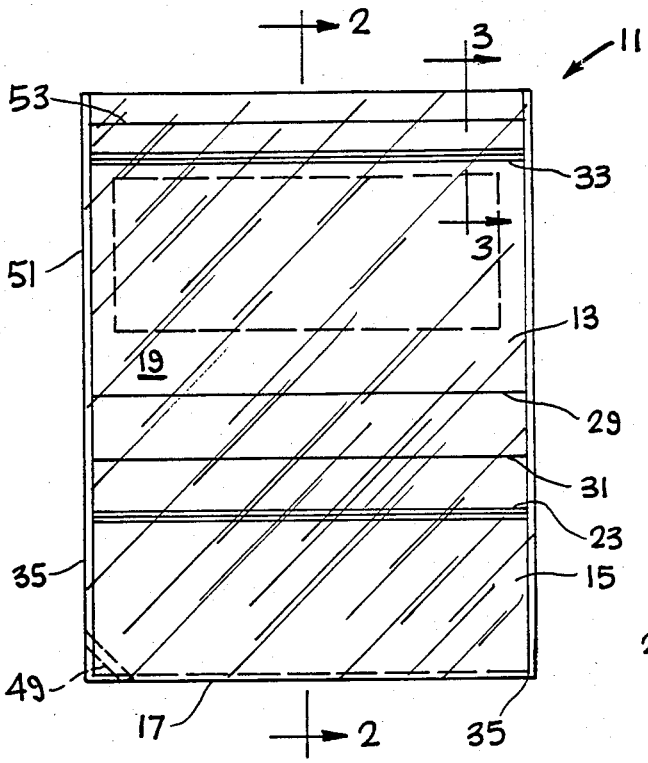
FIG. 1 is a plan view of the front of a specimen container in accord with the present invention.
Figure 2:
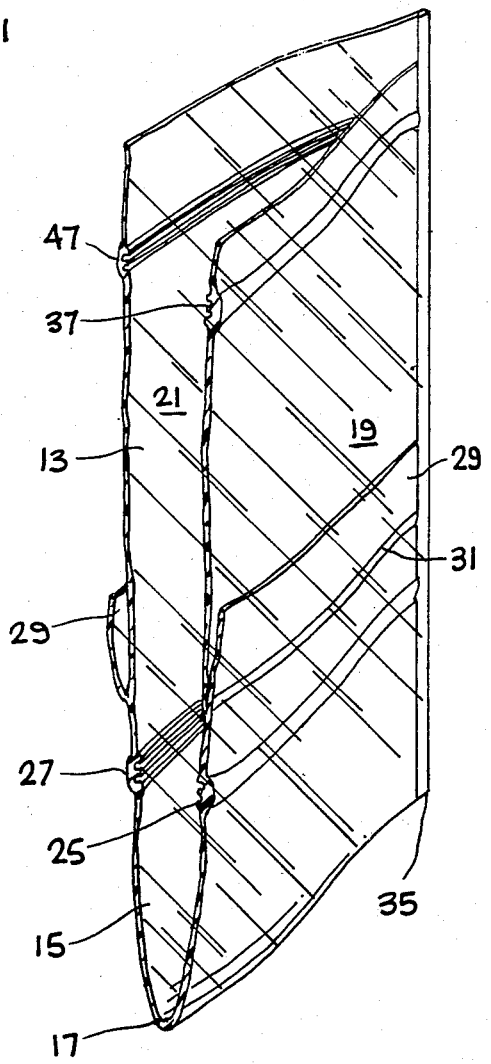
FIG. 2 is a sectional view of the container taken along lines 2—2 of FIG. 1.

With reference to FIGS. 1 and 2, a container or bag 11 is seen to have an upper chamber 13 and a lower chamber 15. The container consists of a folded sheet of heat sealable plastic material with the fold 17 forming a front wall 19 and back wall 21 to the container. The two chambers 13, 15 are selectively sealed apart by a press-fit, reclosable, leak-proof interior fastener 23. Such a fastener is shown in U.S. Pat. Nos. 3,847,711 and 3,986,914, both to Howard. The interior fastener 23 is an interlocking, multiple track, reclosable fastener having two longitudinally extending mating portions 25,27. The front wall 19 carries the first mating portion 25 and the back wall 21 carries the second mating portion 27. Exertion of pressure on the interior fastener 23 will cause the mating portions 25, 27 to interlock, thereby separating the upper and lower chambers. A gripper flap 29 is heat sealed to each of the walls to facilitate opening of the interior fastener 23. FIG. 1 shows the heat seal 31 to be along an area above the interior fastener 23 but the exact position of the heat seal is not critical.

The top edges of the front and back walls 19, 21 carry two mating portions of the reclosable, leak-proof entrance fastener 33. Like the interior fastener 23, the entrance fastener is an interlocking, multiple track, reclosable fastener.

In fabrication of the container 11, the mating portions and the gripper flaps 29 are normally affixed to the walls by thermal sealing. The layers of material to be welded are held together by a pair of jaws, one of which is a heater jaw. The heater contains a heating element with a low heat capacity. The heater jaw is designed to heat and to cool rapidly. An electrical current is applied to the heater in order to fuse two layers of material but the temperature does not reach a point which would cause the material to flow. It is not critical that the fasteners and gripping flaps be heat sealed. Hot-melt adhesives which provided adequate sealing are known.

After the mating portions of the fasteners have been welded to the sheet of material which makes up the walls 19, 21 the material is folded. The electrostatic forces derived from the heat sealing operation hold the walls together, leaving the container substantially devoid of air. At this point the mating portions of the fasteners 23, 33 are interlocked by exerting a force on the outside surfaces of the fasteners.

The next step in fabricating the container is to heat seal the side edges 35. Unlike the previous seals, the side edges are brought to a temperature which causes the material to flow. The pressure and heating operation causes the side edges to stretch over the surfaces of the fasteners 23, 33 in order to eliminate any spaces at the outside junctions of the mating portions. Heat sealing is discussed more fully in U.S. Pat. No. 3,988,184 to Howard.

The walls 19, 21 of the container are typically made of polyethylene or a low density polyethylene-coated material such as material marketed under the trademark Saranex, sold by Dow Chemical Co., that is approximately 0.003 inches thick. Many specimens are preserved in odorous fixatives such as formaldehyde. The polyethylene or Saranex material acts as a barrier film to form an odor- and air-tight container. Preferably, the material is a coextruded laminate of polyethylene-Saranpolyethylene, also known as Saranex.

The fasteners 23, 33 should also be composed of polyethylene. The fasteners should provide a bacteria-resistant entry to a container for storage and transportation of sterilized solutions and specimens.

Figure 3:
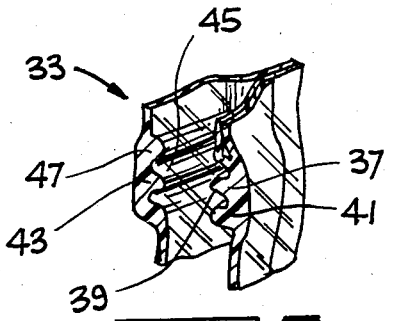
FIG. 3 is a sectional view of the container taken along lines 3—3 of FIG. 1.
Figure 4:
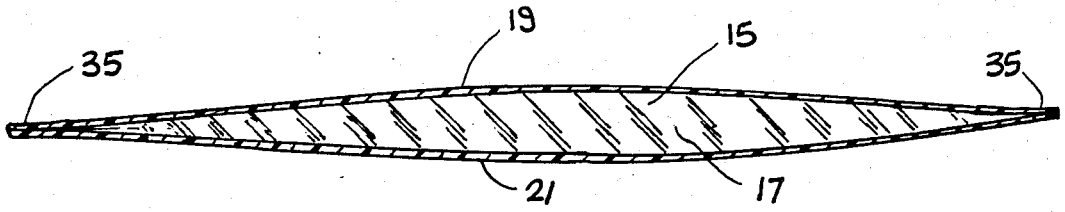
FIG. 4 is a bottom view of the container of FIG. 1.

FIG. 3 illustrates one embodiment of the entrance fastener 33. A first mating portion 37 comprises two parallel longitudinally extending protrusions 39 and two parallel grooves 41. The protrusions 39 and grooves 41 are aligned to interlock with corresponding protrusions 43 and grooves 45 on the second mating strip 47. The material of the fasteners is flexible so that pressure on the outside surfaces of a fastener will cause the two mating portions to interlock and hold the container in a liquid-tight condition. All four mating portions 25, 27, 37, 47 of the container 11 are an integral part of a rectangular strip of material. It is these strips of material which are sealed to the walls 19, 21. The strip of material which makes up the second mating portion 47 is greater in height than than which makes up the first mating portion 37. This difference in height is shown by line 53 in FIG. 1 and is to facilitate opening of the entrance fastener 33.

While FIG. 3 shows each mating position to include two generally semi-circular protrusions and grooves, it will be understood that other configurations may be used. Likewise, it may be possible to provide fasteners which do not contain protrusions and grooves, but instead provide a liquid-tight and bacteria-resistant seal using some other sealing means, such as mutual adhesion between contacting members.

A container 11 which arrives off of a fabrication line has both fasteners 23, 33 sealed shut. The container meets the requirements of food grade containment but is not sterilized. To prevent problems which would occur if the container were filled with solution from the entrance, the container is clipped to form a filler port 49. By metering solution through the bottom of the container, possible contamination of the upper chamber 13 is avoided. The filling port 49 is cut at an angle of approximately 45 starting at a half inch from the side edge 35. Once the solution has been added to the bottm chamber, the filling port 49 is heat sealed closed. An alternative filler port may be produced by piercing the bottom chamber side or bottom edge with a filler needle. After solution has been added, the filler port is closed by heat sealing.

Figure 5:
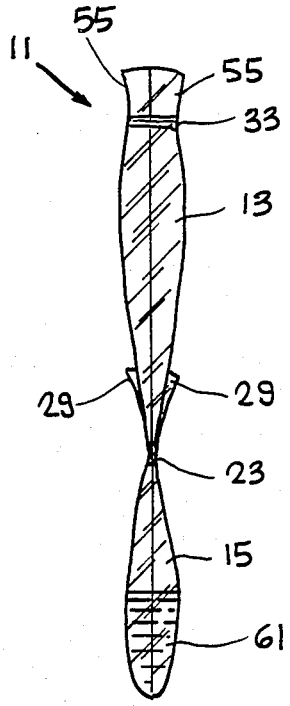
FIG. 5 is a side view of the container of FIG. 1.

FIG. 5 illustrates a partially filled container. The solution rounds out the center area of the folded bottom 17. Thus, a specimen is much less likely to become trapped at the bottom of a container than if the container were constructed of two sheets of material sealed at the bottom. This is especially important with small specimens such as human tissue less than 1 millimeter square.

Solution having been placed in the bottom chamber 15, the container must then be labeled. Printed on or attached to the front wall 19 is an identification label 51. The label 51 may be heat sealed to the front wall or affixed by an adhesive or may be an integral portion of the wall defined by a printed border. The label is formatted to contain such information as the patient's identification, the type, control number, and expiration date of the solution, and the range of tests which the particular specimen is to be subjected. Certain information may be color coded to avoid errors. For example, the label 51 may contain color printing to distinguish the solution, with green printing designating a growth medium, blue designating a saline solution, and red designating formaldehyde.

At times it is imperative that the container 11 be sterilized before use. One sterilization method is as follows. The container is sterilized by first unsealing the fasteners and placing the container under vacuum. A sterilizing gas such as ethylene oxide is then caused to pass through the walls of the container. After the vacuum is removed, the interior of the bag remains sterile. A sterile fixative or transport solution can be added to the container aseptically. Another sterilization method involves use of ionizing radiation, such as gamma radiation from a nuclear source. The container and solution are sterilized simultaneously using gamma radiation.

FIGS. 5–8 illustrate the container 11 in operation. FIG. 5 shows a pre-filled container before a specimen is placed in the upper chamber 13. Medical or laboratory personnel label the container, then open the entrance fastener 33 by pulling the upper edges 55 apart. Care must be taken not to rupture the interior fastener 23.

Figure 6:
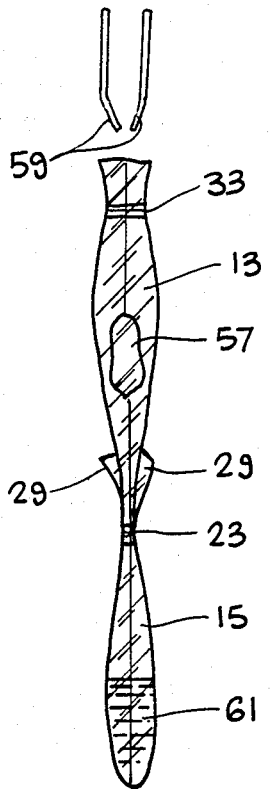
FIG. 6 illustrates the container of FIG. 5 with a specimen.
Figure 7:
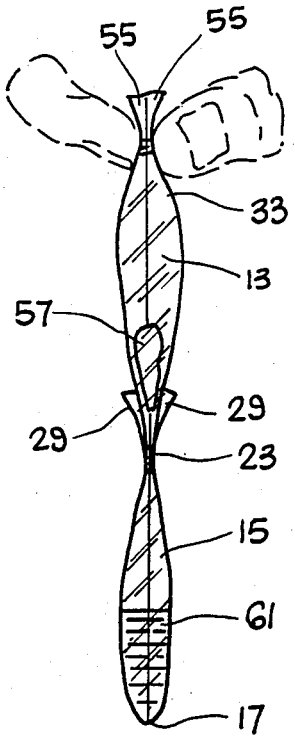
FIG. 7 illustrates the closing of the container of FIG. 6.

In FIG. 6 a specimen 57 is placed in the upper chamber 13 by a surgical instrument 59. The interior fastener 23 remains sealed, preventing the specimen 57 from entering the solution 61. FIG. 7 illustrates the next step taken by the user. The entrance fastener 33 is sealed by an exertion of pressure on the outer surfaces of the fastener. The closure should be checked by gently squeezing the upper half of the container. The entrance fastener 33 should be sufficiently secure to prevent air from escaping from the upper chamber 13. If air does escape the entrance fastener 33 must be resealed and rechecked.

Figure 8:
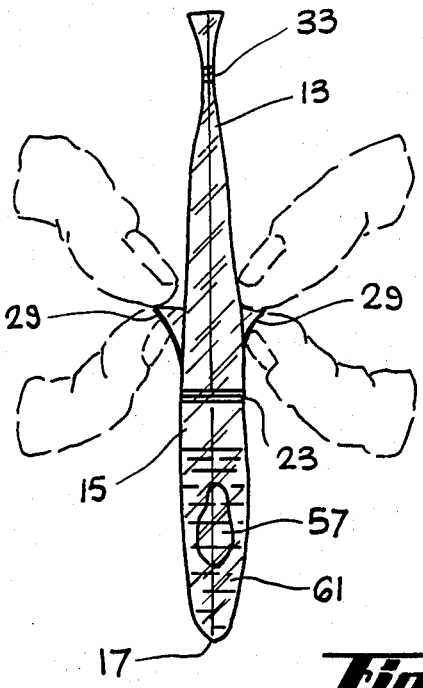
FIG. 8 illustrates the mixing of specimen and solution in the container of FIG. 7, resulting in a container ready for transport.

Finally, as shown in FIG. 8, the gripper flaps 29 are grasped and gently pulled apart to break the seal of interior fastener 23. This combines the solution 61 and specimen 57. The specimen and solution should then be mixed by inverting the container.

As can be seen in FIG. 7, a specimen 57 can wedge itself into tight areas. It is for this reason that the present invention includes a folded bottom 17. The folded bottom eliminates the crevices that would exist if the two walls 19, 21 were heat sealed together at the bottom edges.

Containers fabricated in accord with the present invention may be made in a variety of sizes. Typically, the container is either 4×7 inches with approximately 30 cc of solution, 6×8 inches with approximately 60 cc of solution or 9×12 inches with approximately 150 cc of solution.

The drawings show a container having two chambers but it is to be understood that a container may have three chambers or more. Each chamber should be selectively sealed by a reclosable interior fastener with gripper flaps associated with each fastener.

In this application, the present invention has been described in connection with clinical laboratory uses. However, the invention may be used in connection with foods, microbiology, and other industrial applications.

I claim:

1. A unitary specimen, sample collection and transport container comprising, a flexible rectangular bag having a fluid-tight bottom and having first and second generally parallel side walls, said side walls having joined side edges and free upper edges, said free upper edges defining an entrance to said bag, said walls each having an inner surface and an outer surface, a leak-proof, repeatedly reclosable entrance fastener having a pair of linear mating portions, said mating portins fixed to opposed upper edges of said first and second walls to selectively seal said entrance, and at least one leak-proof, repeatedly reclosable interior fastener disposed between the upper edges and said bottom, each interior fastener having a linear first mating portion and a linear second mating portion, said linear portions parallel to the linear mating portions of the entrance fastener, each first mating portion fixed to an inner surface of a wall, each second mating portion fixed to an inner surface of a wall opposite a first mating portion, said interior fasteners combining with said entrance fastener to define a plurality of selectively sealable chambers.

2. The container of claim 1 wherein said mating portions of the entrance fastener include a plurality of opposed protrusions and grooves substantially transversing said entrance, each protrusion aligned with an opposed groove for resilient locking engagement therewith.

3. The container of claim 1 wherein said first mating portion and said second mating portion of the interior fastener each have a plurality of parallel protrusions and grooves, each groove of a mating portion aligned with a protrusion of the other mating portion for resilient locking engagement therewith.

4. The container of claim 1 wherein said first and second walls are defined by a fold of a sheet of material, said fold providing a fluid-tight bottom for said container.

5. The container of claim 1 having gripping means attached to the outer surfaces of said first and second walls for opening of said interior fastener.

6. The container of claim 5 wherein said gripping means is a rectangular strip of material having a longitudinal edge affixed to a wall parallel to a mating portion.

7. The container of claim 1 having an identification label attached to said first wall.

8. A unitary specimen, sample collection and transport container comprising, a rectangular sheet of flexible heat sealable material having a fold defining first and second generally parallel side walls and fluid-tight bottom, said side walls having joined side edges and free upper edges, said free upper edges providing an entrance to the container, said walls each having an inner surface and an outer surface, a repeatedly reclosable, leak-proof entrance fastener having first and second linear mating portions, said first mating portion fixed to said free upper edge of the first wall, said second mating portion fixed to said free upper edge of the second wall to selectively seal the entrance, and at least one leak-proof, repeatedly reclosable interior fastener disposed between the upper edges and said bottom to define a plurality of chambers, each interior fastener having linear first and second mating portions, each first mating portion fixed to an inner surface of a wall, each second mating portion fixed to an inner surface of a wall opposite a first mating portion, said linear portions parallel to the linear mating portion of the entrance fastener.

9. The container of claim 8 wherein said first and second mating portions of said entrance fastener each include a plurality of parallel protrusions and grooves, substantially traversing said entrance fastener, each protrusion of a mating portion aligned with a groove of the other mating portion for interlocking therewith.

10. The container of claim 8 wherein said first and second mating portions of said interior fastener each include a plurality of parallel protrusions and grooves, substantially traversing said interior fastener, each protrusion of a mating portion aligned with a groove of the other mating portion for interlocking therewith.

11. The container of claim 8 having gripper flaps affixed to said outer surfaces of the walls, said gripping flaps substantially traversing said walls parallel to said interior fastener whereby pulling said gripper flaps away from said walls ruptures said interior fastener.

12. A unitary specimen, sample collection and transport container comprising, a flexible rectangular bag with opposed generally parallel side walls being fluid tight at bottom regions thereof and having free top edges and a leak-proof reclosable entrance fastener, at least one leak-proof reclosable interior fastener disposed between the bottom regions and the top edges, each interior fastener having a linear first mating portion and a linear second mating portion, said linear portions parallel to the linear mating portions of the entrance fastener, each first mating portion fixed to an inner surface of a wall opposite a second mating portion, said interior fasteners combining with said entrance fasteners to define a plurality of selectively sealable chambers, said mating portions each having a plurality of parallel protrusions and grooves, each groove of a mating portion aligned with a protrusion of an oppositely disposed mating portion for resilient locking engagement therewith, and gripping means attached to the outer surfaces of said first and second walls for opening of said interior fastener.

13. The container of claim 12 wherein said gripping means is a rectangular strip of material having a longitudinal edge affixed to a wall parallel to a mating portion.

* * * * *

UNITED STATES PATENT AND TRADEMARK OFFICE

CERTIFICATE OF CORRECTION

PATENT NO. : 4,637,061

DATED : January 13, 1987

INVENTOR(S) : J. Richard Riese

It is certified that error appears in the above—identified patent and that said Letters Patent is hereby corrected as shown below:

Column 2, line 16, the words "transport container. the" should read - -transport container. The- -.

Column 2, line 20, the words "coextruded plastic pag" should read - -coextruded plastic bag- -.

Column 2, line 23, the words "mid-section of the bag. this interior" should read - -mid-section of the bag. This interior- -.

Column 2, line 25, the words "spaced therfrom" should read - -spaced therefrom- -.

Column 2, line 36, the words "constructed by folging" should read - -constructed by folding- -.

Column 2, lines 43-44, the words "This elminates handling" should read - -This eliminates handling- -.

Column 2, line 60, the words "and so the chance of infection" should read - -and so is the chance of infection- -.

UNITED STATES PATENT AND TRADEMARK OFFICE

CERTIFICATE OF CORRECTION

PATENT NO. : 4,637,061

DATED : January 13, 1987

INVENTOR(S) : J. Richard Riese

It is certified that error appears in the above—identified patent and that said Letters Patent is hereby corrected as shown below:

Column 2, line 65, the words "transportation is entirely selfcontained" should read - -transportation is entirely self-contained- -.

Column 4, line 17, the word "Saranpolyethylene" should read - -Saran-polyethylene- -.

Column 4, line 58, the last word "bottm" should read - -bottom- -.

Claim 1, column 6, lines 17-18, the words "said mating portins" should read - -said mating portions- -.

Signed and Sealed this

Twenty-first Day of April, 1987

*Attest:*

DONALD J. QUIGG

*Attesting Officer*

*Commissioner of Patents and Trademarks*